United States Patent [19]

Lewis, Jr.

[11] Patent Number: 4,620,344

[45] Date of Patent: Nov. 4, 1986

[54] FRICTION APPLYING ASSEMBLY

[75] Inventor: Walter E. Lewis, Jr., Louisville, Ky.

[73] Assignee: General Electric Company, Louisville, Ky.

[21] Appl. No.: 765,819

[22] Filed: Aug. 15, 1985

[51] Int. Cl.[4] ..... E05C 17/64; E05D 1/108

[52] U.S. Cl. ..... 16/337; 16/339

[58] Field of Search ..... 16/319, 337, 339, 342

[56] References Cited

U.S. PATENT DOCUMENTS

| | | | |
|---|---|---|---|
| 2,110,128 | 3/1938 | Kent | 312/112 |
| 2,362,664 | 11/1944 | Reed | 85/1 |
| 2,553,158 | 5/1951 | Zillman | 287/101 |
| 2,976,101 | 3/1961 | Rooney | 312/300 |
| 3,058,795 | 10/1962 | Siegal et al. | 312/194 |
| 3,559,232 | 2/1971 | Crane | 16/339 |
| 3,939,529 | 2/1976 | Davis | 16/179 |
| 4,018,104 | 4/1977 | Bland et al. | 74/531 |

*Primary Examiner*—James G. Smith
*Assistant Examiner*—Maurina Rachuba
*Attorney, Agent, or Firm*—Frederick P. Weidner; Radford M. Reams

[57] ABSTRACT

A friction applying assembly for a panel movable from a first position to a second position which includes a mounting plate rigidly secured to the panel with the plate having a non-circular aperture. There is a hinge support arm having at one end a non-circular aperture and a bolt arm having a head at one end, which bolt arm is inserted into the non-circular aperture of the hinge support arm to prevent relative movement between the bolt arm and hinge support arm. The bolt arm is elongated having a large diameter section adjacent the head and a smaller diameter section at the opposite end and a tapered conically shaped intermediate section between the large diameter section and small diameter section. An elongated bushing body having one end inserted into the non-circular aperture of the mounting plate is secured thereto to prevent relative movement between the bushing and mounting plate. The bushing has an internal tapered conically shaped cavity complementary to and in frictional engagement with the intermediate section of the bolt arm. A compression spring having one end seated against the bushing and the opposite end retained by fastener means on the smaller diameter section of the bolt arm urges the bushing into movable frictional engagement with the tapered conically shaped intermediate section of the bolt arm.

7 Claims, 5 Drawing Figures

FRICTION APPLYING ASSEMBLY

BACKGROUND OF THE INVENTION

The present invention is directed to a friction applying assembly for a panel movable from a first position to a second position. The friction applying assembly is particularly useful in connection with a counter panel for a household refrigerator including a fresh food compartment having access thereto through a main fresh food door. It is advantageous in household refrigerators to have a separate small exterior panel on the main door of the fresh food compartment that will fold down and be a work surface such as a small counter for preparing drinks or snacks. In such an arrangement it is desirable to have the hinge supports for such a counter panel exert a constant uniform friction so that the door will not fly open when unlatched and slam down during the movement of the panel from its closed position to a horizontal open position. It is therefore desirable in a movable panel such as a small exterior counter panel on the main door of a fresh food compartment of a refrigerator to have a constant uniform friction applied to the hinge assembly for opening and closing the panel. One problem in connection with a friction applying assembly is that after a period of time and extended usage of the assembly the amount of friction will decrease and the desirable qualities of the friction applying assembly are no longer functional.

By this invention there is provided a friction applying assembly for a panel movable from a first position to a second position that will apply a constant uniform friction to the mechanism and that constant uniform friction will remain functional during the extended use of the assembly.

SUMMARY OF THE INVENTION

There is provided a friction applying assembly for a panel movable from a first position to a second position, which includes a mounting plate having a non-circular aperture rigidly secured to the panel. A hinge support arm having at one end thereof a non-circular aperture is also provided and a bolt arm having a head at one end is inserted into the non-circular aperture of the hinge support arm to prevent relative between the bolt arm and hinge support arm. The bolt arm is elongated and has a large diameter section adjacent the head and a smaller diameter section at the opposite end with a tapered conically shaped intermediate section between the large diameter section and small diameter section. A bushing having an elongated body has one end inserted into the non-circular aperture of the mounting plate and is secured thereto to prevent relative movement between the bushing and mounting plate. The bushing has an internal tapered conically shaped cavity complementary to and in frictional engagement with the intermediate section of the bolt arm. A compression spring having one end seated against the bushing and the opposite end retained by fastening means on the smaller diameter section of the bolt arm urges the bushing into movable frictional engagement with the tapered conically shaped intermediate section of the bolt arm. This assembly arrangement provides for a constant and uniform frictional engagement of the moving parts when the panel is moved from a first position to a second position and back to the first position repeatedly during usage of the panel.

BRIEF DESCRIPTION OF THE DRAWINGS

With reference to the accompanying drawing.

DESCRIPTION OF THE PREFERRED EMBODIMENT

Figure 1:
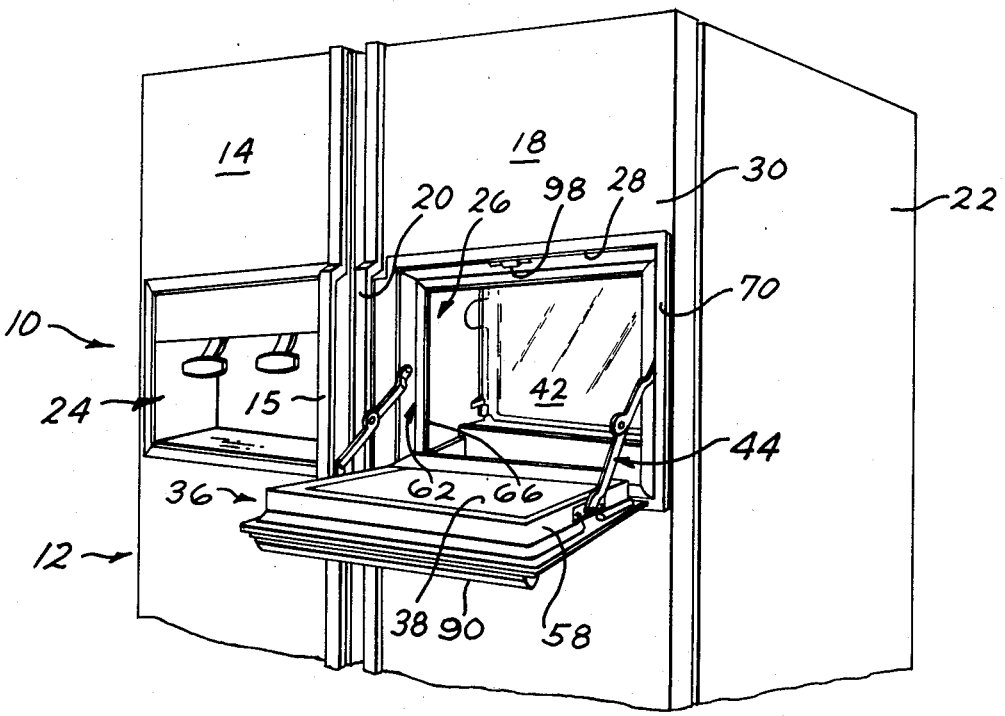
FIG. 1 is a perspective view of a portion of a household refrigerator of the side-by-side type including a counter panel incorporating the present invention and showing the panel in its open horizontal position.
Figure 2:
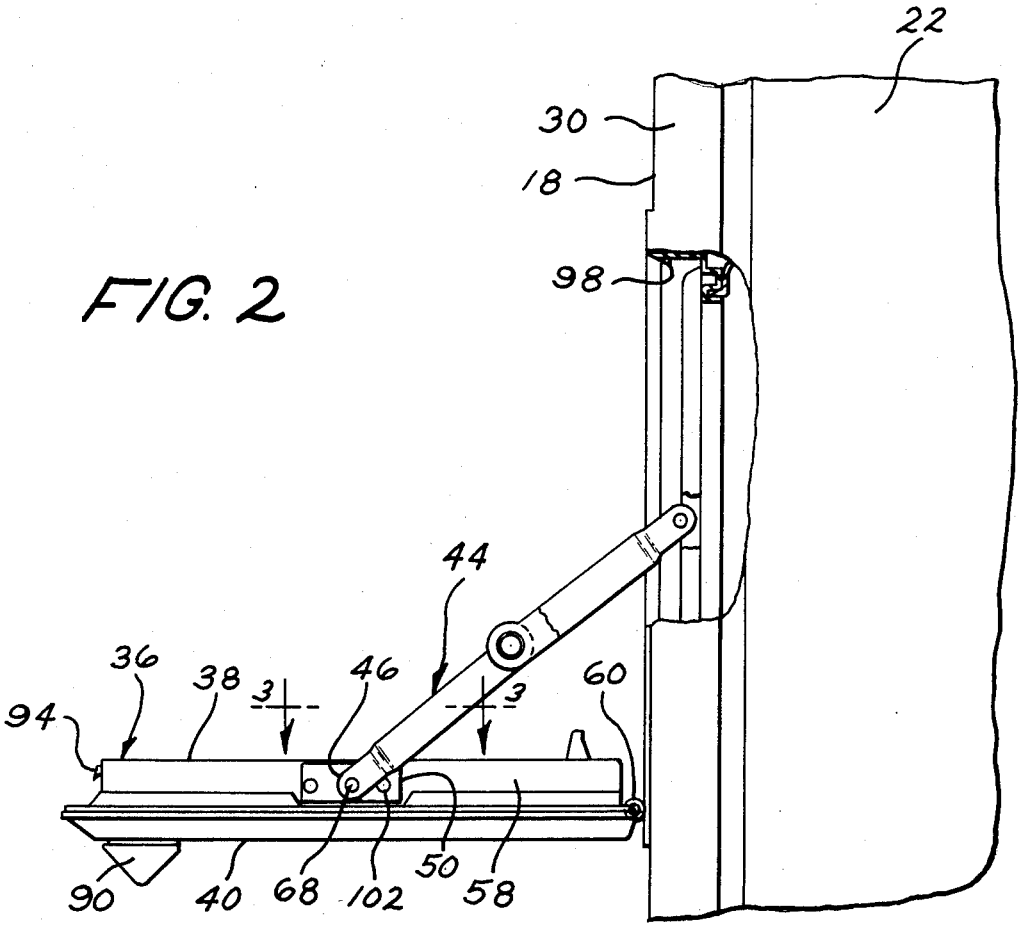
FIG. 2 is a side elevational view of a portion of the refrigerator shown in FIG. 1 with the counter panel shown in its open position and incorporating the friction applying assembly of the present invention.

With reference to the accompanying drawings, there is shown, particularly in FIGS. 1 and 2, a household refrigerator 10 including a freezer compartment 12 having a below freezing temperature and a fresh food compartment 16 having an above-freezing temperature. Each compartment having an access opening at the front thereof closed by a main freezer door 14 having a handle 15 and fresh food door 18 having a handle 20, respectively. The drawings illustrate a side-by-side type of refrigerator where the freezer compartment 12 is on one side and the fresh food compartment 16 is on the other side and the compartments are separated by an insulation partition (not shown). Both compartments are thermally insulated by suitable material from the outside case 22. In the drawings, there is also shown an ice through-the-door service area 24 whereby the user may obtain ice pieces without the need for opening the main freezer door 14 as described in Jacobus et al U.S. Pat. Nos. 3,572,053; Drieci 3,602,007 and Swerbinsky 3,621,668, all of which are assigned to the same assignee as the present invention.

Located on the fresh food door 18 adjacent the ice through-the-door service area 24 of the freezer is a counter assembly which includes a compartment 26 in the fresh food door 18 with an outer access opening 28 in the outer door member 30 and an inner access opening 32. An outer closure or panel 36 has an inner panel 38 and an outer panel 40. The outer panel 36 is pivotally mounted at the bottom thereof and lockable at the top to the outer door member 30 for sealing the outer access opening 28 in a first position which is closed (not shown) and pivotally movable outwardly therefrom to a second open horizontal counter position as shown in FIGS. 1 and 2. An inner closure 42 is pivotally mounted to the door for partially sealing the inner access opening 32 in the door.

Surrounding the access opening 28 is a plastic thermal break frame member 62 which carries a gasket 66 for sealing against the inner surface 38 when the outer panel 36 is in the closed position. On the front surface of the outer door member 30 and again surrounding the outer access opening 28 there is a decorative trim strip 70 to add a pleasing appearance. One or more hinges 60 secure the outer panel 36 at the bottom thereof to the fresh food door 18.

The outer panel 36 has means for latching it in its first or closed position and unlatching it to pivotally move it to its second or open horizontal counter position. Such latching means could be magnetic or in the case of the preferred embodiment a mechanical interlock. A movable handle 90 is located along the upper edge of the outer panel and secured to a latch member 94 that is movable up and down vertically in response to the movement of handle 90. The latch member 94 engages a complementary hook shaped element 98 which is secured to the door 18 at the top of the access opening 28. To use the work surface of panel 36 the user manually raises the handle 90 disengaging the hook shaped element 98 and pivots the outer panel about the hinges 60 down to the horizontal position shown in FIGS. 1 and 2. The support for the outer panel 36 in the horizontal position is provided by hinges 60 and two folding support arms 44, one on each side of the outer panel, and pivotally secured at one end to the side walls 58 of the outer panel and the opposite end of the folding support arms 44 is pivotally secured to the fresh food door 18. There is provided a door hinge stop 102 that limits the movement of the outer panel 36 to the horizontal position by the folding support arms 44 abutting the stop 102 when the outer panel is in its proper horizontal position. The user now has a work surface which is inner panel 38 available for fixing a beverage or preparing a snack and also has access to the contents within the compartment 26. When finished the user may grip the outer panel 36 and raise it to the closed position whereupon the folding support arms 44 fold and the latch member 94 and hook shaped element 98 are engaged to retain the outer panel in its closed position.

It is desirable that the outer panel 36 when moved from its first position to its second position and back to the first position that a substantially constant force needs to be exerted against the outer panel 36 for opening and closing it so that it does not fall or slam down to its open horizontal position by merely unlatching the outer panel 36 from its closed position. To accomplish this result there is provided a friction applying assembly that interconnects the hinge support arms 44 and the outer panel 36, one friction applying assembly for each support arm. The components of these friction applying assemblies and their arrangement is shown particularly in FIGS. 3–5. There is provided at the one end 46 of the hinge support arms 44 a non-circular aperture 48 which in the preferred embodiment has straight sides such as a square hole. A mounting plate 50 also having a non-circular aperture 52 is rigidly secured to the outer panel 36 by fasteners 54 through openings 56 on either side of the non-circular aperture 52 in the mounting plate 50 which are received into the side walls 58 of the outer panel 36 thereby rigidly securing the mounting plate to the panel. There is a bolt arm 64 having a head 68 at one end thereof with a non-circular element 69, such as square, complementary to the non-circular aperture 48 and inserted into the non-circular aperture 48 of the hinge support arms 44. By this arrangement then there is prevented relative movement between the bolt arm and the hinge support arm. The bolt arm 64 is elongated with a larger diameter section 72 adjacent to the non-circular element 69 and a smaller diameter section 74 at the opposite end of the bolt arm and a tapered conically shaped intermediate section 76 between the large diameter section 72 and the small diameter section 74.

Figure 3:
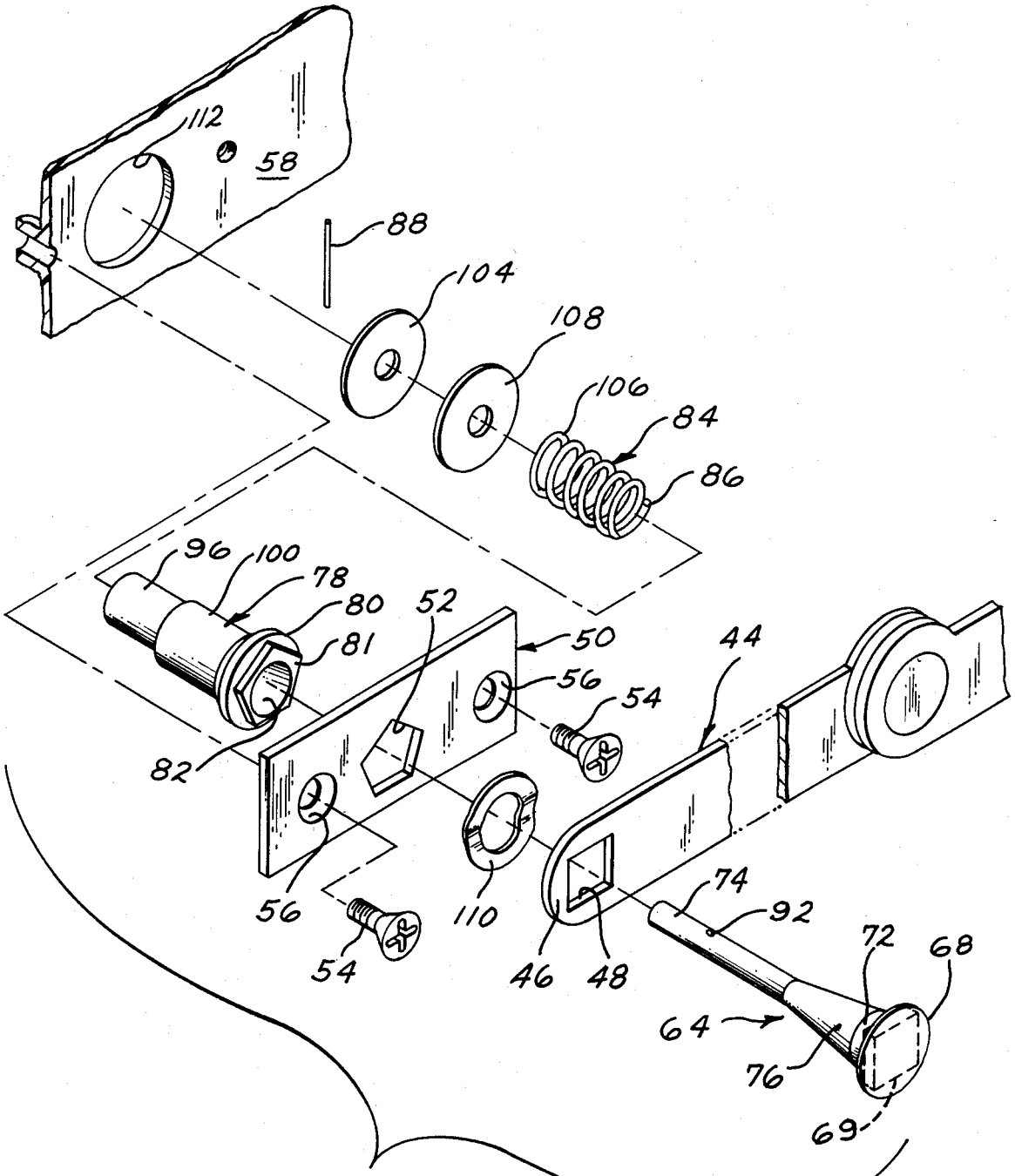
FIG. 3 is an exploded perspective view of the component parts of the friction applying assembly of the present invention.

The friction applying assembly further includes a bushing 78 having an elongated body with one end 80 having a non-circular element 81 complementary to the non-circular aperture 52 and inserted into the non-circular aperture 52 of the mounting plate 50 and secured thereto to prevent relative movement between the bushing 78 and mounting plate 50. In the preferred embodiment the non-circular aperture 52 and non-circular element 81 are pentagon shaped as shown in FIG. 3. The bushing 78 has an internal tapered conically shaped cavity 82 (FIGS. 4 and 5) which is complementary to and in frictional engagement with the intermediate section 76 of the bolt arm 64. There is a coiled compression spring 84 having one end 86 seated against the bushing 78 and the opposite end retained in a fixed position by fastening means on the smaller diameter section 74 of the bolt arm 64. In the preferred embodiment the fastening means is a pin 88 through a bore 92 in the smaller diameter section 74 of the bolt arm 64. This arrangement provides that the bushing is constantly forced or urged into movable frictional engagement with the tapered conically shaped intermediate section 76 of the bolt arm 64. To conveniently seat the compression spring 84 against the bushing 78, the bushing of the preferred embodiment has two sections, one section 96 has a smaller diameter than the other section 100 with a shoulder 102 between the two sections 96 and 100 against which the end 86 of spring 84 seats. The length of compression spring 84 is larger than the length of section 96 so that the spring is always in compression. There is also provided a washer 104 between the fastening means 88 and the end 106 of the compression spring. For ease in operating the friction applying assembly, there is between the washer 104 and the end 106 of the compression spring 84 a slip washer 108 that rotates with the spring that will allow smooth relative movement between the washer 104 and the end 106 of the compression spring 84. For the same reason there may also be provided a slip washer 110 between the mounting plate 50 and the one end 46 of the support arm 44.

Figure 4:
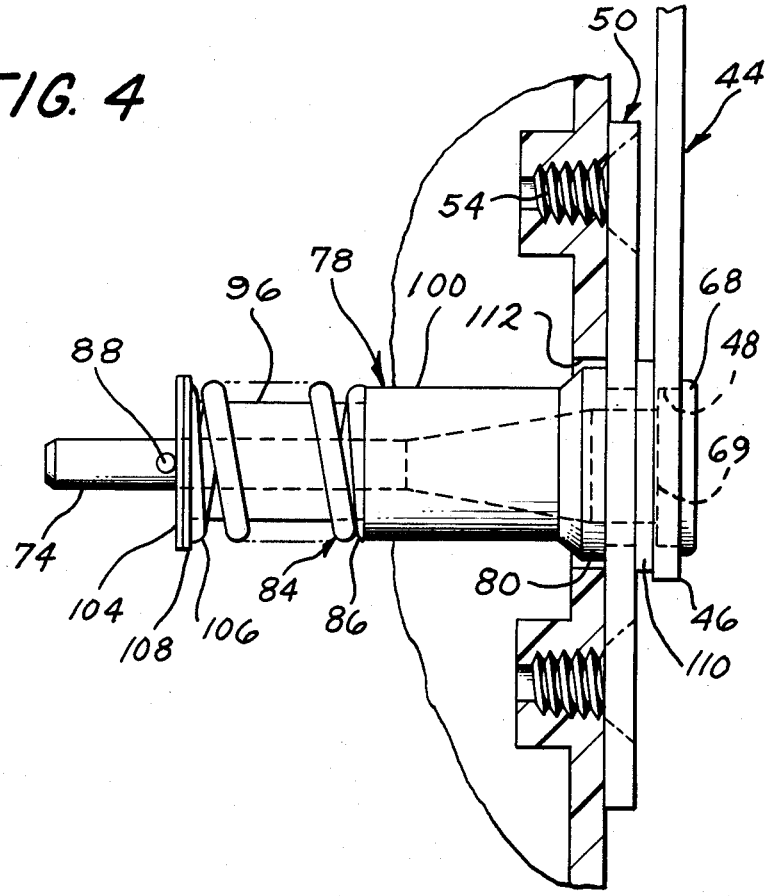
FIG. 4 is a view partially in cross section of the friction applying assembly of the present invention taken along lines 3—3 of FIG. 2.
Figure 5:
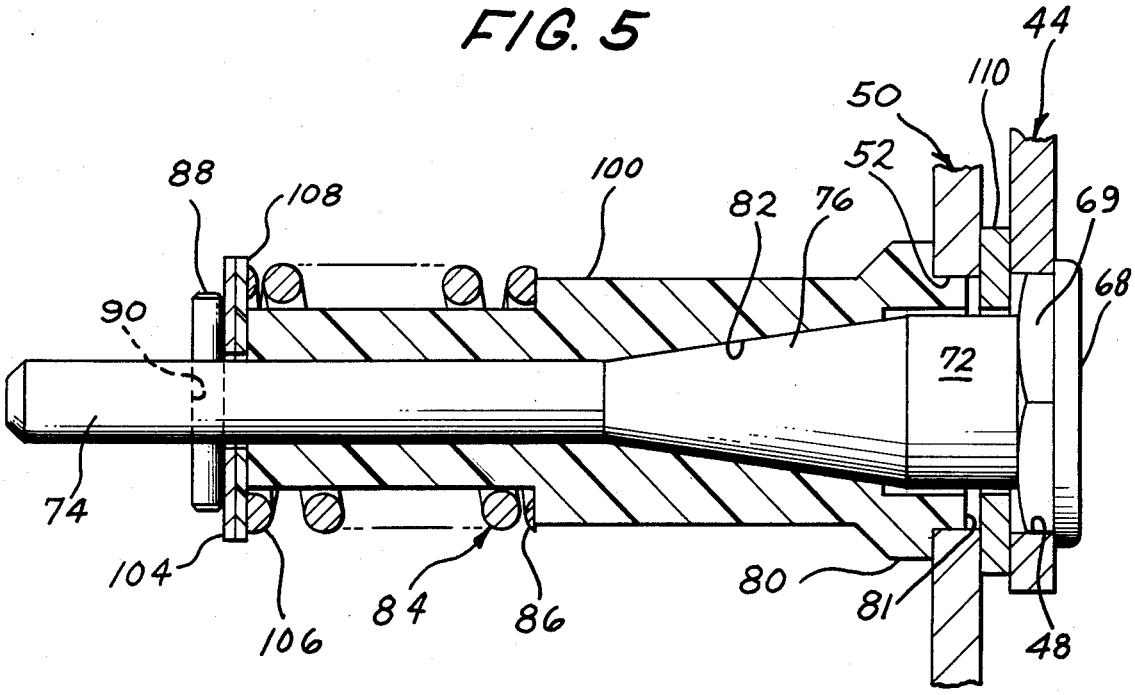
FIG. 5 is a cross-sectional view of the friction applying assembly of the present invention showing the assembled components similar to FIG. 4 and enlarged.

The friction applying assembly described in connection with FIG. 3 above is shown in its assembled arrangement in FIGS. 4 and 5. It will be noted that there is provided an aperture 112 in the side wall 58 of panel 36 to allow a portion of the assembly to pass into the panel as shown particularly in FIGS. 4 and 5. It can be seen that by this friction applying assembly as the outer panel 36 is moved between its first closed position and second open position that the hinge support arms 44 must move relative to the mounting plate 50 and there is a constant frictional force between the tapered conically shaped intermediate section 76 of the bolt arm 64 which is preferably metal and the internal tapered conically shaped cavity 82 of the bushing 78 which is preferably plastic and this force is transmitted to the mounting plate 50 and hinge support arms 44. Also, if during repeated movement of the panel 36 there becomes wear in the friction applying assembly, the wear tolerance is taken up by the compression spring 84 exerting force against the bushing 78 to continuously keep the walls of the internal tapered conically shaped cavity 82 in constant contact frictionally with the tapered conically shaped intermediate section 76 of the bolt arm 64.

While there has been shown and described a specific embodiment of the invention, it will be understood that it is not limited thereto and it is intended by the appended claims to cover all such modifications as fall within the true spirit and scope of the invention.

What is claimed is:

1. A friction applying assembly for a panel movable from a first position to a second position comprising:

a mounting plate rigidly secured to the panel, said plate having a non-circular aperture, a hinge support arm having at one end thereof a non-circular aperture, a bolt arm having a head at one end inserted into the non-circular aperture of the hinge support arm to prevent relative movement between the bolt arm and hinge support arm, the bolt arm being elongated with a large diameter section adjacent the head and a smaller diameter section at the opposite end and a tapered conically shaped intermediate section between the large diameter section and small diameter section, a bushing having an elongated body with one end inserted into the non-circular aperture of the mounting plate and secured thereto to prevent relative movement between the bushing and mounting plate, and an internal tapered conically shaped cavity complementary to and in frictional engagement with the intermediate section of the bolt arm, a compression spring having one end seated against the bushing and the opposite end retained by fastening means on the smaller diameter section of the bolt arm, whereby the bushing is urged into movable frictional engagement with the tapered conically shaped intermediate section of the bolt arm.

2. The friction applying assembly of claim 1 wherein the elongated body of the bushing has two sections with one having a smaller diameter than the other with a shoulder between the two sections and the spring seats against said shoulder.

3. The friction applying assembly of claim 1 wherein the mounting plate non-circular aperture has straight sides and the bushing body end inserted into the aperture has complementary mating straight sides received in the aperture to prevent relative movement between the bushing and mounting plate.

4. The friction applying assembly of claim 1 wherein the fastening means for retaining the compression spring is a pin through a bore in the smaller diameter section of the bolt arm.

5. The friction applying assembly of claim 4 wherein a washer is located between the spring and pin.

6. The friction applying assembly of claim 5 wherein there is a slip washer located between the washer and spring.

7. The friction applying assembly of claim 1 wherein the bolt arm is metal and the bushing is plastic.

* * * * *